United States Patent [19]

Post et al.

[11] 3,967,556

[45] July 6, 1976

[54] PNEUMATIC FUZE FOR SAFING AND ARMING MISSILES

[75] Inventors: Lloyd D. Post, Mount Fern; William J. Holley, Sparta, both of N.J.; William K. Clark; Fredrick R. Hayward, both of Wilmington, Mass.

[73] Assignee: The United States of America as represented by the Secretary of the Army, Washington, D.C.

[22] Filed: Mar. 31, 1975

[21] Appl. No.: 563,766

[52] U.S. Cl. ..... 102/70.2 GA; 102/78; 102/81; 102/70.2 P

[51] Int. Cl.[2] ..... F42C 5/00; F42C 11/02; F42C 15/40

[58] Field of Search ..... 102/81, 78, 70.2 R, 102/70.2 GA, 70.2 P

[56] References Cited

UNITED STATES PATENTS

| | | | |
|---|---|---|---|
| 3,034,437 | 5/1962 | Schermer et al. | 102/70.2 GA |
| 3,035,520 | 5/1962 | Koeppen | 102/70.2 GA |
| 3,359,904 | 12/1967 | Nerheim | 102/70.2 GA |
| 3,742,857 | 7/1973 | Schmidt et al. | 102/70.2 GA |
| 3,804,020 | 4/1974 | Norton | 102/81 |
| 3,850,102 | 11/1974 | Morrow | 102/70.2 GA |

*Primary Examiner*—David H. Brown
*Attorney, Agent, or Firm*—Nathan Edelberg; A. Victor Erkkila; Max Yarmovsky

[57] ABSTRACT

A pneumatic point detonating fuze utilizes the environmental parameters of the setback acceleration and projectile to accomplish safing and arming functions. Launch acceleration is utilized to unlock a fluidic system and allow it to respond to the air stream velocity. Upon completion of the arming cycle the fluidic system enables a mechanical-electrical fuzing system by closing electrical contacts and rotating out-of-line detonators so that they are in-line with an explosive train. A setback magnetic pulse generator operates at launch to charge a firing capacitor in an electronic switching circuit. Piezoelectric elements operate in conjunction with a trigger circuit to provide a firing signal at impact.

7 Claims, 11 Drawing Figures

PNEUMATIC FUZE FOR SAFING AND ARMING MISSILES

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to provide a high performance point detonating fuze for artillery and mortar munitions. The problem with prior art fuzes used in a nonspinning environment was that they were not generally capable of being launched without a premature detonation when all of the safing features were subverted. Another problem with prior art safing and arming devices, used in high performance artillery and mortar munitions, was their inability to reverse their arming sequence if for some reason the sequence was interrupted prior to reaching the "armed" condition. Another problem with prior art nonspinning artillery and mortar arming systems was their inability to reliably arm the munition at a constant distance from the launching weapon.

SUMMARY OF THE PRESENT INVENTION

The present invention relates to a pneumatic system for safing and arming nonspinning high performance point detonating artillery and mortar munitions. A fluidic system in combination with mechanical, electrical, and electromechanical elements safe, arm, and fire the fuze. The present system provides a means for directly measuring the distance traveled by the projectile and arms the projectile at a constant distance from the muzzle of the launch weapon. The present fuze is capable of operating for spinning and nonspinning rounds over a velocity range from 200 feet per second to 3000 feet per second and can be applied to other munitions such as bombs, rockets and missiles. A venturi airstream sensor develops a pressure differential between the venturi throat and a static pressure probe. The pressure ratio is proportional to projectile velocity and is used to develop a force which moves a piston a distance proportional to the distance the projectile has traveled. In this manner the piston stroke serves as an integrator of the projectile velocity.

An object of the present invention is to provide a safing and arming device for projectiles which will reliably arm the projectile at a constant distance from its point of launch.

Another object of the present invention is to provide a pneumatic system for safing and arming a projectile at a constant distance over a velocity range of 200 feet per second to 3000 feet per second for spinning or nonspinning projectiles.

Another object of the present invention is to provide a pneumatic safing and arming system for a projectile which utilizes a venturi technique to generate pressure differentials on a piston member which in turn develops adequate force to arm a projectile.

Another object of the present invention is to provide a pneumatic fuze which has a relatively constant arming distance for a wide range of projectile velocities.

Another object of the present invention is to provide a pneumatic fuze whose arming distance can be easily varied by varying orifice areas, chamber volume and piston areas.

Another object of the present invention is to provide a pneumatic safe and arm fuze which utilizes a direct measurement of arming distance to remove an arming lock.

A further object of the present invention is to eliminate the necessity for a manually operated pull wire.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
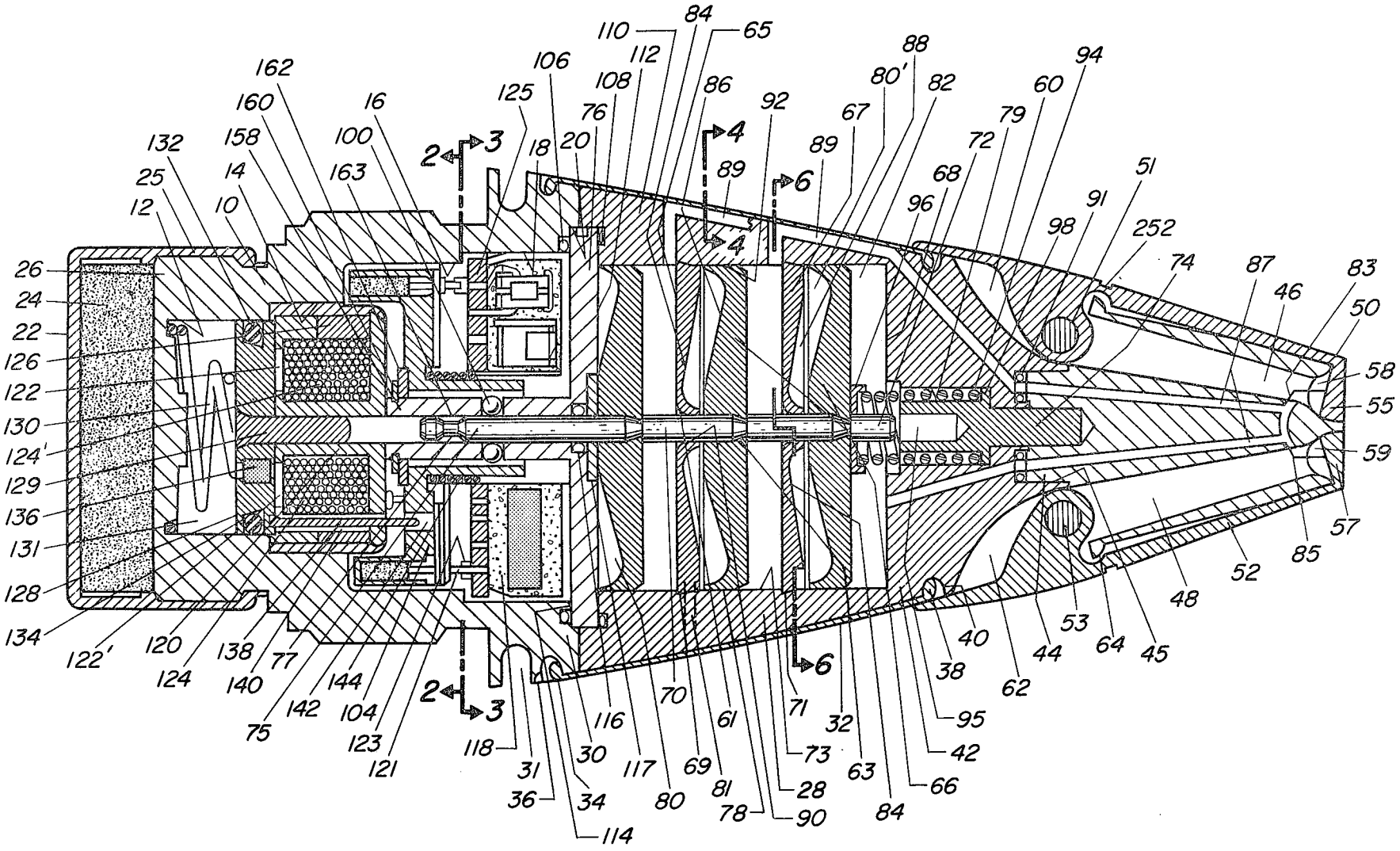
FIG. 1 is a diametral longitudinal partial cross-sectional view of the fuze in an unarmed "safe" condition.
Figures 2, 3, 4, 5:
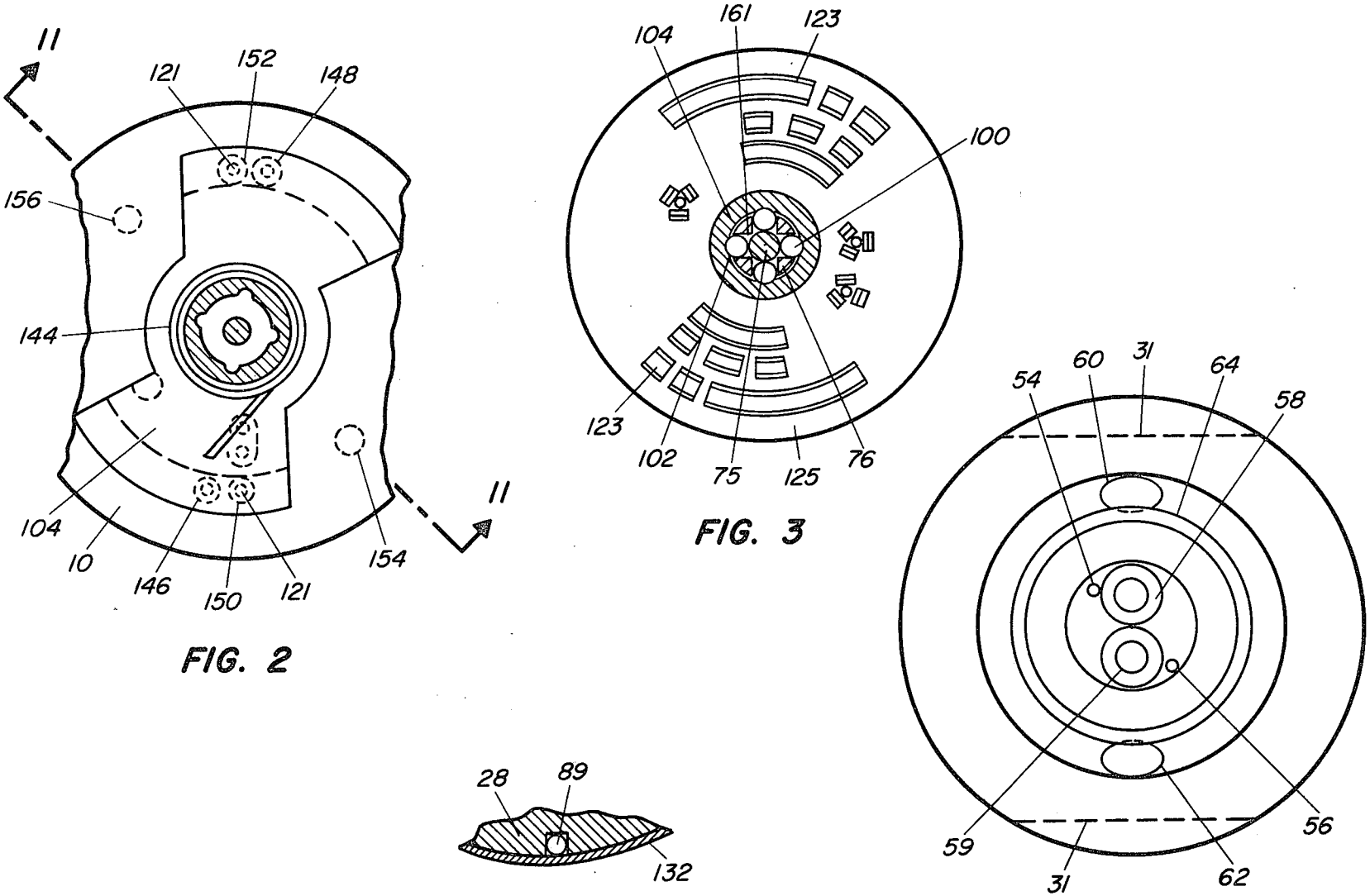
FIG. 2 is a partial cutaway cross-sectional view of the fuze taken along line 2—2 of FIG. 1.
FIG. 3 is a partial cross-sectional view of the fuze taken along line 3—3 of FIG. 1 showing the details of the arming ball detent and the contacts on the stator section of the rotor switch.
FIG. 4 is a partial cutaway cross-sectional view of a low-pressure air channel taken along line 4—4 of FIG. 1.
FIG. 5 is a plan view of the fuze front end taken along line 5—5 of FIG. 11 showing the air inlet ports.

Referring now to FIGS. 1–5, which show the fuze in an unarmed condition, a generally cylindrical cup-shaped rear body housing member 10 has five concentric counterbores, a first counterbore 12, a second counterbore 14, a third counterbore 16, a fourth counterbore 18 and a fifth counterbore 20, axially positioned therein. Each of these counterbores 12–20 are progressively larger than the other. A cup-shaped booster housing 22, which contains a booster explosive 24 therein, has its open end 25 fixedly attached to the partially closed rear end 26 of rear body housing 10. An ogival front body housing member 28 is fixedly attached to the front open end 30 of rear body housing 10 by a hollow conically shaped body cover member 32. A plurality of radially positioned wrench slots 31, used for tightening the fuze to a projectile not shown, are peripherally located in the circumference of the rear end 30 of the rear body housing 10. The rear end 34 of body cover 32 is crimped into a first annular crimping groove 36 located in the peripheral surface of the front end 30 of rear body member 10. The front end 38 of body cover 32 is in a similar fashion crimped into second annular groove 40 located in the tapered forward section 42 of front body housing 28. A nose piece member 44, containing dual venturi chambers 46 and 48 therein, is located in nose counterbore 45 and fixedly attached to the forward section 42 of the front body housing 28. Two disposable protective nose piece covers 50 and 52, having weighted masses 51 and 53 respectively therein, have forward cover extensions 55 and 57 which enclose both high pressure inlet ports 54 and 56 and venturi inlet ports 58 and 59 and venturi exit ports 60, 62 respectively. Covers 50 and 52 prevent debris and contamination from entering venturi chambers 46 and 48 during storage and handling. An annular protrusion 64 located in front of the exit ports 60, 62 acts as an airstream spoiler and has the effect of lowering the exit air velocity and correspondingly the pressure drop experienced within the venturi chambers. A plurality of drive pistons 66 are slidably held in a centrally positioned piston counterbore 68. Counterbore 68 has a pair of annular notches 69 and 71 in its wall surface 73 for holding partition plate members 65 and 67 therein. The pistons 66 are centrally connected by drive shaft notches 63 to a common axially disposed drive shaft 70 which passes through axial partition bore 61 and is slidably supported at its forward end 72 by an axial shaft bore 95, located in a drive shaft guide member 74 which in turn is located in an axially positioned guide counterbore 79, and at the shaft rearward end 75 by a drive shaft support member 76 which has a "T" shaped cross-sectionalized area. The shaft rearward end 75 contains an arming ball detent annular recess 77 therein. The drive pistons 66 have tapered circumferential edges 78 in order to prevent leakage of air between high pressure chambers 80 and low pressure chambers 82. High pressure piston chambers 80 are pneumatically connected to high pressure inlet ports 54 and 56 by high pressure body channels 81. Low pressure piston chambers 82 are pneumatically connected to the nose piece low pressure inlet orifices 83 and 85 by low pressure nose piece channels 87 and low pressure body channels 89. A pair of nose piece "O" ring seals 91 make a leak tight connection between channels 87 and 89 respectively. The high pressure chambers 80 are formed by contouring the forward faces 84 of partitions 65, 67 and the rear piston faces 86 in such manner to provide a suitable expansion chamber 88. The partitions 65 and 67 have axial partition shaft inner sliding and sealing surfaces 90. The pistons 66 have outer peripheral piston wall sealing surfaces 92. In the unarmed position the centrally disposed drive pistons 66 and drive shaft 70 are rearwardly biased as an assembly by the action of coiled piston return spring 94 reacting against spring retainer 96 and the hub end 98 of the drive shaft guide 74. The straight cylindrical rearward shaft extension 75 of drive shaft 70 cams arming balls 100 radially outward into channelures 102 of rotor 104 thereby preventing the latter from rotating when the fuze is in its unarmed condition. First and second shaft support annular O ring seals 106 and 108 respectively are operatively positioned within the front end 30 of the rear body housing 10 and the rear end 110 of the front body 28 so that they bear against drive shaft support member 76 at its outer top and bottom plate surfaces 112 and 114 respectively. A third annular O ring seal 116 is contained in top plate shaft support member surface 112 by a friction reducing spring washer 117. Annular O ring seals 106, 108 and 116 prevent high pressure gases from leaking from the rear high pressure chamber 80 into the fourth rear body housing counterbore 18 which contains a potted electronic circuit 118 therein. A setback operated magnetic generator 120 is electrically connected to the electronic circuit 118 through a plurality of rotor switching contacts 121 located on rotor 104 and by a plurality of sliding channel terminals 123 located on circuit stator board 125. The magnetic setback generator 120 comprises a pair of soft iron cores 122, 122' around which two separate wire coils 124 and 124' respectively are wound for redundancy, and a permanent magnet 126. A magnet keeper element 128, having an axial keeper guide pin 129 fixedly attached thereto, acts as a fast response, slow return setback detent for the rotor 104. The keeper 128 is biased toward the generator 120 by a conical helical keeper return spring 130 located in return spring chamber 131. The keeper 128 is sealed around its circumference by a keeper O ring seal 132 which is located in a tapered annular O ring groove 134. The tapered seat of groove 134 allows the O ring seal to relax when the keeper is moved in a rear direction by the inertial force of setback. A porous plug 136 acts to retard the motion of keeper 128 in its forward direction for a first interval of time during the arming cycle. Keeper 128 has a lock pin 138 fixedly attached to its front face surface and passes through the magnetic generator lock pin bore 140 and protrudes into an axially aligned rotor safing hole 142 thus providing a mechanical restraint for the torsionally biased rotor 104. Rotor arming spring 144 is basedly attached to rotor 104 and provides the spring force for rotating rotor 104 when the fuze is in its armed condition. When the fuze is in its unarmed condition as shown in FIGS. 1 and 2, electrically actuated superquick detonator squibs 146 and 148 and delay detonator squibs 150 and 152 are held in an out-of-line position with respect to lead explosives 154 and 156 located in lead bores 155 and 157 resepectively. Rotor 104 is rotatably positioned on support member shaft 158 by snap ring 160 and a bearing washer 162. Support member 76 has a plurality of radially positioned transverse ball holes 161 therein, which permit balls 100 to slide therethrough, and an axial shaft bore 163.

Figure 7:
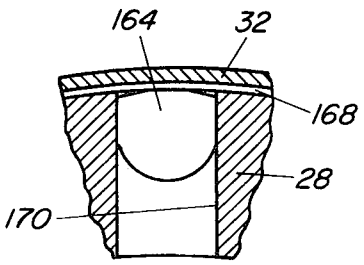
FIG. 7 is an enlarged partial cutaway cross-sectional view of FIG. 6.
Figure 8:
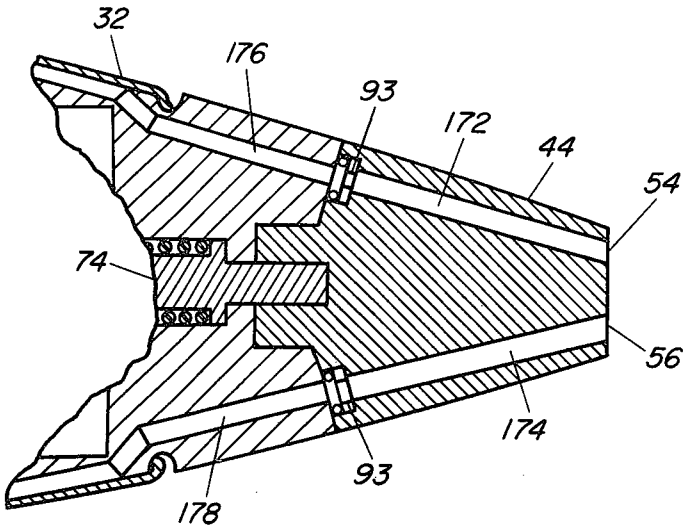
FIG. 8 is a partial cutaway cross-sectional view taken along line 8—8 of FIG. 6 through the nose section of the fuze showing the high pressure nose channels.
Figure 6:
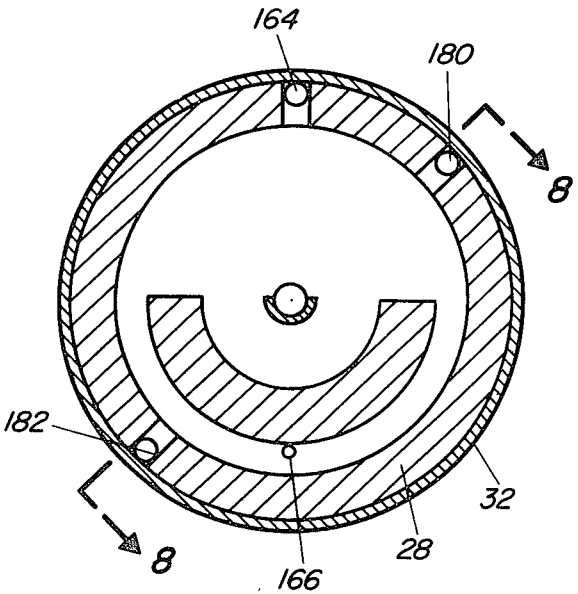
FIG. 6 is a cross-sectional view taken along line 6—6 of FIG. 1 showing the high pressure and low pressure channels.

Referring now to FIGS. 1, 6 and 7, low pressure gases entering venturi inlet ports 83 and 85 are channeled into low pressure piston chambers 82 through low pressure nose channels 87 and body channels 89, and via low pressure exit orifices 164 and 166. A sealant material 168 is positioned intermediate to cover 32 and front body housing 28 in order to prevent gases from escaping from radial channel 170 to the atmosphere. In a similar manner, referring now to FIGS. 1, 6 and 8, high pressure gases entering high pressure inlet ports 54 and 56, of nose piece 44, are channeled into the high pressure chamber areas 80, 80' via high pressure nose channels 172, 174 through high pressure orifice member 93 into high pressure front body channels 176, 178 and then through exit high pressure orifices 180 and 182.

Figure 9:
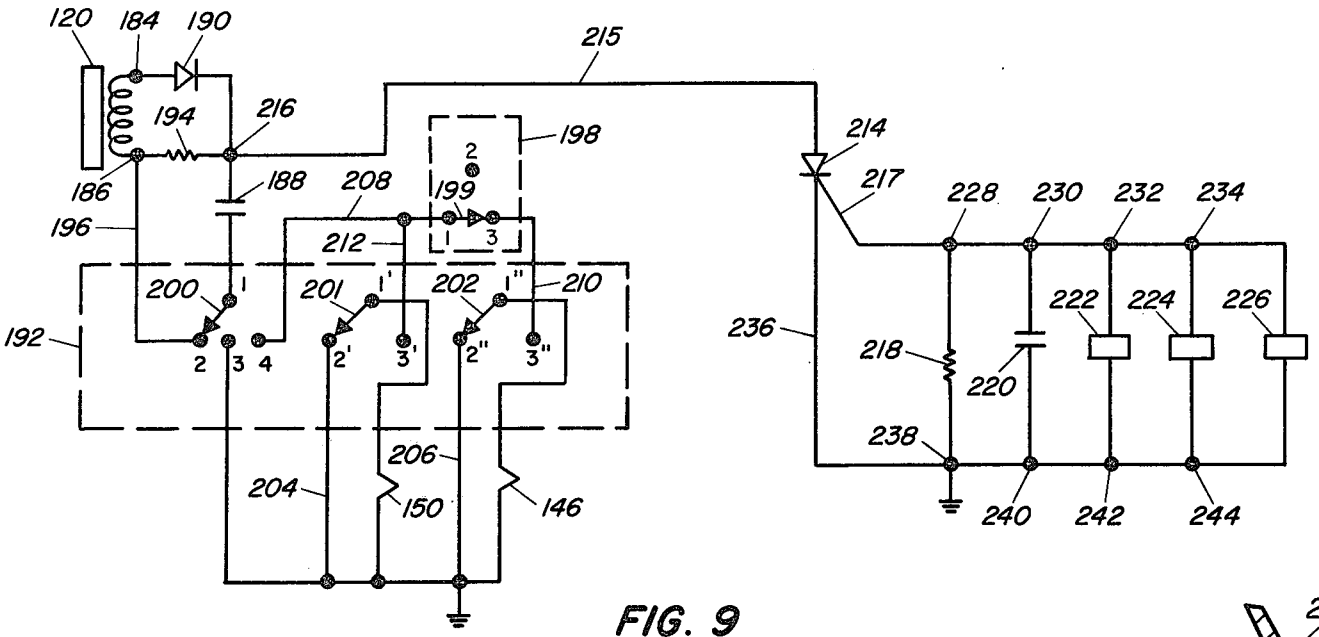
FIG. 9 is a schematic drawing of one half of a redundant electronic circuit used in the fuze.
Figure 10:
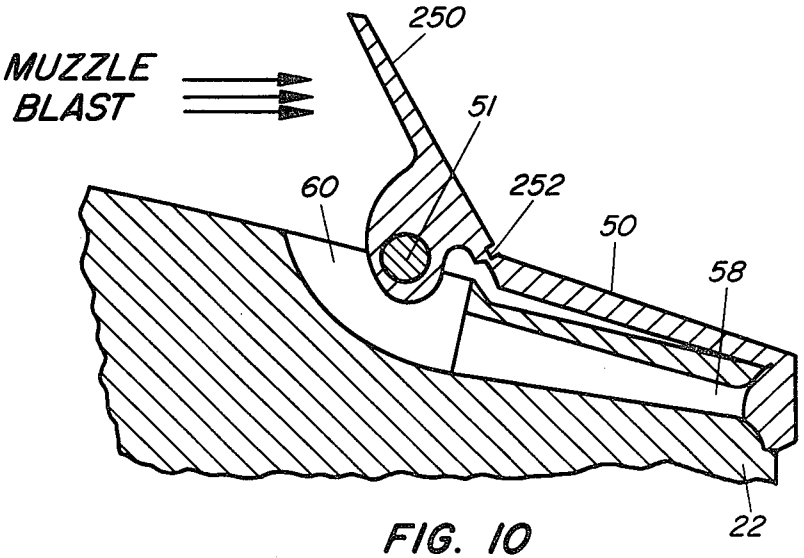
FIG. 10 is a partial longitudinal cross-sectional view through the nose portion of the fuze showing the protective cover being removed automatically by muzzle blast during launch.
Figure 11:
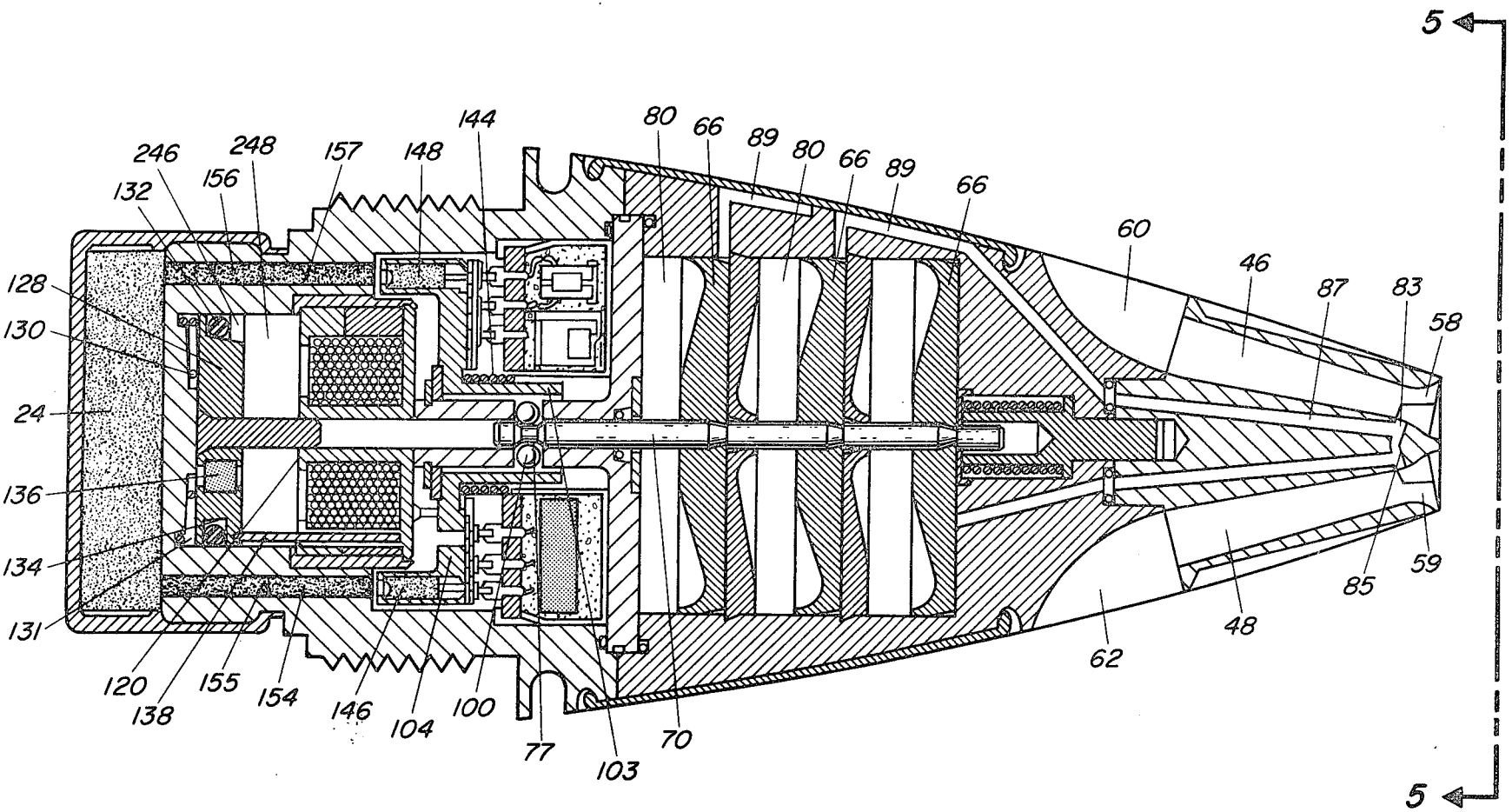
FIG. 11 is a partial longitudinal cross-sectional view taken along line 11—11 of FIG. 2 of the fuze in an armed condition with the rotor rotated clockwise so that detonator squibs are axially in-line with the lead explosives.

Referring now to the electrical schematic of FIG. 9, which represents one half of a redundant circuit, aforedescribed as electronic circuit 118, the output voltage generated across terminals 184 and 186 of pulse generator 120 is used to charge an energy storing capacitor 188 through a series connected diode 190 and through the normally closed contact 2 of rotor arm switch 192. A resistor 194 is connected in parallel across the energy storing capacitor 188 by electrical conductor 196 and via the normally closed contact 2 of rotor arm switch 192. The resistor 194 is used to discharge capacitor 188 at a controlled rate in the event that arming does not occur.

A manually operated switch 198, having a pole piece 199, is used in conjunction with rotor arm switch 192, to preselect the use of either a superquick detonator mode or a delay detonator mode. When the pole piece 199 of switch 198 is placed in contact with terminal 3, the fuze will function in a superquick detonator mode. When the pole piece 199 of switch 198 is placed in contact with terminal 2, the fuze will function in a delay detonator mode. When the fuze sees a proper arming environment, rotor arming switch 192 will move ganged pole pieces 200, 201 and 202 from switch terminals 2, 2′ and 2″ to rotor switch 192 terminals 4, 3′ and 3″ respectively thereby removing shorting leads 204 and 206 from across delay detonator 150 and superquick detonator 146. In addition pole piece 200, when in contact with terminal 4, connects a first side of the charged capacitor 188 through conductor 208 and switch 198 to rotor switch terminal 3′ or 3′ and 3″ depending upon whether manual switch 198 pole piece 199 is in contact with terminal 2 or terminal 3. In the superquick mode the superquick detonator 146 is connected to the first side of the firing capacitor 188 through conductor 210, switch 198, lead conductor 208, and pole piece 200 in contact with terminal 4. The delay detonator 150 is connected in parallel with superquick detonator 146 by conductor 212 and pole piece 201 in contact with terminal 3. Pole piece 200 of rotor arming switch 192 has a midposition contact terminal 3. Terminal 3 of arming switch 192 is included for added safety. In the event that a fault condition causes silicon rectifier 214 to become conductive prior to an impact, the mid-position contact terminal 3 allows capacitor 188, to discharge to ground, thereby preventing the circuit from firing on arming. Silicon controlled rectifier (SCR) 214 which has its collector connected to the second side of the firing capacitor 188 at junction point 216 by conductor 215 is normally biased to cut off. The SCR trigger electrode 217 is connected to a first side of parallel connected resistor 218, capacitor 220, graze sensitive impact piezoelectric transducers 222, 224 and nose impact transducer 226 at junction points 228, 230, 232 and 234 respectively. In a similar manner the silicon controlled rectifier cathode lead 236 is connected to the second side of the aforementioned elements at grounded junction points 238, 240, 242 and 244 respectively. At termination of the flight, impact forces sensed by any of the piezoids 222, 224 or 226, located in the nose member 44, generate a voltage signal of sufficient value to cause SCR 214 to switch from its cut off condition to a high conductance mode which connects the second side of the energy storage capacitor 188 to either the grounded sides of the delay detonator 150 or to delay detonator 150 in parallel with superquick detonator 146 thus causing these detonators to be energized.

Referring now to FIGS. 1, 9, 10 and 11 in order to better follow the sequence of operation, when the projectile and attached fuze have been subjected to a gun tube launch environment, setback acceleration forces the removal of magnetic keeper 128 from the magnetic setback generator 120 creating an air gap in the generator magnetic circuit with an associated reduction of magnetic flux. The magnetic flux change induces a voltage pulse across generator output terminal 184 and 186 which charges energy storage capacitor 188 which then retains the peak voltage generated due to the presence of diode 190. In the event that complete arming does not occur, the resistor 194 will discharge capacitor 188 at a controlled rate. The rearward movement of keeper 128 causes lock pin 138 to be withdrawn from rotor safing hole 142, thus removing the first detent on rotor 104. The rearward motion of the magnetic keeper 128 is partially restrained by the force of the compressed return spring 130 and by the air partially compressed in the return spring chamber 131. However, some of this compressed air is bled around the O ring seal 132 and out of a series of relief ports 246 into the free volume 248 created by the separation of the keeper 128 and the magnetic setback generator 120. This rearward motion of the keeper 128 is aided by the tapered annular groove 134 being released from the inside diameter of the O ring seal 132. The tapered groove 134 allows relaxation of the seal 132 when keeper 128 is acting in a rearward direction. The action of the removal of lock pin 138 does not by itself permit angular rotation of rotor 104 since it remains locked to the support shaft member 158 by the four arming balls 100 as shown in FIG. 3. The return of the magnetic keeper 128 to its original forward position, as shown in FIG. 1, is delayed for a first interval of time by the return flow of air entrapped in the volume 248 by having to pass through porous plug 136 in order to return into return spring chamber 131. This delay is adjustable depending on the selection of porosity for plug 136. During the in-bore acceleration phase of firing, setback forces act on weights 51 and 53 causing the rearward extensions 250 of covers 50 and 52 to hinge radially outward at hinge grooves 252, thus uncovering the exit ports 60, 62. Upon exit from the gun tube, not shown, muzzle blast gases react on the extended portions 250 of the covers 50, 52. The muzzle blast gases push the covers 50, 52 off the fuze thereby exposing the venturi inlet ports 58, 59 and high pressure inlet ports 54 and 56. Removal of either protective covers 50 or 52 by the muzzle blast gases would be sufficient to permit operation of the fuze. Upon the fuze exiting the gun tube, the venturi chambers 46 and 48, sense air flow due to projectile velocity. The stagnation air pressure at the front face of the fuze causes air to enter high pressure channels 54 and 56, shown in FIG. 5, and is distributed to the high pressure piston chamber areas 80 of the drive pistons 66. In addition the venturi throat air pressure is sensed at the venturi inlet orifices 83, 85 and this air is transmitted via low pressure channels 87, 89 to the low pressure chamber 82. The arming delay is a function of the stagnation pressure and the throat pressure across the drive pistons 66. This second time interval may be controlled by varying the size of the orifice members 93 in the high pressure lines 172 and 174, shown in FIG. 8, and the diameter of the venturi inlet orifices 83 and 85 at the venturi throats. The force to move the drive pistons 66 and operate the removal of the radial restraint on the arming balls 100 and the axial restraint of piston return spring 94, is provided by the difference in pressure across pistons 66. The arming balls 100 are removed as a restraint, when the pistons 66, as a result of a difference in air pressure across their front and rear faces of approximately one pound per square inch, causes forward translation of drive shaft 70. The forward movement of drive shaft 70 aligns the drive shaft recess 77 with the arming balls 100, allowing them to be forced radially inward, due to the torquing movement applied through the hub portion 103 of rotor 104 by rotor arming spring 144. When the rotor 104 swings into alignment, detonators 146 and 148 are mechanically aligned with lead explosives 154 and 156 respectively and are electrically unshorted by conductors 204 and 206. In addition, the movement of rotor 104 moves the pole pieces 200, 201 and 203 from their unarmed position on contact terminals 2, 2' and 2'' to contact terminals 4, 3' and 3''. At the termination of flight, the impact forces sensed either by one or both of the nose impact piezoids 226 or one or more graze impact piezoids 222, 224, will generate a voltage signal of sufficient value to cause the silicon controlled rectifier 214 in the trigger circuit to switch to the high conductance mode, thereby discharging the energy stored in capacitor 188 into superquick detonators 146 and 148 if switch 198 has its pole piece 199 in contact with terminal 3 or into delay detonators 150, 152 if switch 198 has its pole piece 199 positioned in contact with terminal 2, and thus initiating explosive trains 154 and 156 and in turn booster explosive 24.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. A pneumatic point detonating fuze for safing and arming a projectile which comprises:

a cup-shaped rear body housing having a partially closed rear end, a front open end, a plurality of progressively sized axially aligned rear body housing counterbores extending from said closed rear end toward said front open end, and a plurality of longitudinally positioned lead explosive bores, said lead bores communicating with said rear body counterbores and exiting from said rear end;

a plurality of lead explosive charges longitudinally positioned in the lead bores of said rear body housing;

a booster explosive means fixedly attached to said partially closed end of said rear body housing;

an ogival front body housing having a rear end section fixedly positioned concentric with and adjacent to said front open end of said rear body housing, a tapered forward section, an axial piston counterbore located in said rear end section having a plurality of annular notched partition grooves therein, an axial guide counterbore communicating with said piston counterbore, an axial nose counterbore located in said tapered forward section and communicating with said guide counterbore, and a plurality of high and low pressure channels pneumatically connecting said nose counterbore with said piston counterbore;

body cover means for fixedly holding said front body housing attached to said rear body housing;

torsionally biased rotary arming means for holding said fuze in a "safe" unarmed condition when said fuze has not been subjected to a proper launch environment, and for placing said fuze in an "armed" condition when said fuze has received a proper launch environment;

biased setback generator-detent-delay means, positioned in said rear body housing counterbores, for providing electrical energy to said arming means, for preventing said arming means from rotating when said fuze in said "safe" condition, and for controllably delaying the redetenting of said arming means for a first interval of time after said fuze has been subjected to said launch environment;

pneumatic piston detent means, slidably positioned in the piston counterbore of said front body housing, for detenting said rotary arming means until said projectile has obtained a proper velocity and for permitting said rotary arming means to rotate and place said fuze in said armed condition when said projectile has seen said proper velocity; and venturi nozzle sensing means for detecting said projectile air velocity and for directing high and low pressure air through said high and low pressure channels into said piston counterbore, wherein the difference in pressure across said piston detent means causes forward translation of said piston detent means and the release of said torsionally biased rotary arming means; and a plurality of piezoelectric graze and impact sensors, operatively positioned in the nose end of said nozzle sensing means, are electrically connected to a triggering circuit energized by said generator-detent-delay means when said fuze is in said armed condition, said graze and impact sensors activating said triggering circuit and causing said fuze to detonate upon impact with a target.

2. A pneumatic point detonating fuze as recited in claim 1 wherein said booster explosive means comprises:

a cup-shaped booster housing; and a booster explosive positioned in said booster housing intermediate said housing and the partially closed end of said rear body housing.

3. A pneumatic point detonating fuze as recited in claim 1 wherein said body cover means comprises a hollow conically shaped member having a rear end crimped to said front open end of said rear body housing and a front end of said cover crimped to said tapered forward section of said ogival front body housing.

4. A pneumatic point detonating fuze as recited in claim 1 wherein said rotary arming means comprises:

a T shaped support member having a plate section fixedly positioned in a fifth counterbore of said plurality of rear body counterbores intermediate the front end of said rear body housing and the rear end of said front body housing and a hollow shaft section having a plurality of radial transverse ball bores therein;

a first O ring seal located in the front end of said rear body housing intermediate said front end and one face of said support member plate section;

a second O ring seal located in the rear end of said front body housing intermediate said front end and the other face of said support member plate section, said first and second O ring seals preventing pressurized air from escaping from the volume of said piston counterbore to said rear body housing;

an electronic triggering circuit fixedly disposed in a fourth counterbore of said plurality of rear body counterbores adjacent said support member plate section, said circuit having a stator terminal board having a plurality of contact terminals thereon connected thereto;

a rotor member rotatably positioned in a third counterbore of said plurality of rear body counterbores and supported on said shaft section of said T shaped support member, said rotor having a plurality of detonator squibs fixedly positioned therein so that said detonator squibs are out-of-line with said lead explosives when said fuze is in a safe condition, and said detonator squibs being in axial alignment with said lead explosives when said fuze is in an armed condition, said squibs being electrically connected to a plurality of rotor switching contacts and being electrically connected to said triggering circuit through said contact terminals of said stator terminal board, said rotor member having an axial hollow hub section having channelures therein which cooperate with said piston detent means in holding said rotor member in said out-of-line position when said fuze is in a safe position, and a rotor safing pin hole therein;

a helical rotor arming spring biasedly attached to said rotor member which applies a torsional force to said rotor member and which causes said rotor member to rotate from said squib-lead out-of-line position to said in-line position when said fuze is in said armed condition.

5. A pneumatic point detonating fuze as recited in claim 1 wherein said setback generator-detent-delay means comprises:

a magnetic iron core fixedly positioned in a second counterbore of said plurality of rear body counterbores;

a magnet coil circumambient said iron core having its output connected to said triggering circuit;

a magnet keeper having an axial guide pin fixedly attached to said keeper, said keeper having a tapered annular groove located in the peripheral surface of said keeper, and a plurality of relief ports communicating with said annular groove and the first counterbore of said rear body housing;

a lock pin fixedly positioned in said magnet keeper and in sliding engagement with said rotor safing hole when said fuze is in said safe condition;

a keeper O ring seal positioned in said tapered annular groove permits said lock pin to be quickly withdrawn from said rotor safing hole;

a conically shaped keeper return spring positioned intermediate said partially closed rear end of said rear body housing and said keeper provides a spring force for holding said keeper lock pin in said rotor safing hole;

a porous plug longitudinally positioned in said keeper permits air to pass through said keeper in a fixed first interval of time and thereby provides a delay for the return of said lock pin into engagement with said rotor safing hole.

6. A pneumatic point detonating fuze as recited in claim 1 wherein said pneumatic piston detent means comprises:

a plurality of partition plate members having axial bores therein, said axial bores having inner sliding sealing surfaces therein, and outer peripheral sealing surfaces which are fixedly located in said annular notched partition grooves of said piston counterbore;

a plurality of drive pistons having a common centrally connected drive shaft, said drive shaft having a forward end and a rear end, said shaft rear end having an annular arming ball detent recess therein;

a plurality of arming balls operatively disposed in said radial transverse ball bores of said T shaped support member;

a drive shaft guide member fixedly located in said guide counterbore, said guide member having an axial shaft counterbore therein for slidably holding said drive shaft at its forward end; and a coiled piston return spring biasedly positioned in said guide counterbore circumambient the forward end of said drive shaft and intermediate said drive shaft guide member and one of the end faces of said drive pistons, said return spring providing a rearward bias on said piston and drive shaft assembly when said fuze is in said safe condition, and said return spring being compressed by said drive pistons when said venturi nozzle sensing means has directed a sufficient amount of high and low pressure air through said high and low pressure channels into said piston counterbore as to cause forward translation of said piston drive shaft assembly.

7. A pneumatic point detonating fuze as recited in claim 1 wherein said venturi nozzle sensing means comprises:

a nose piece member, fixedly positioned in said axial nose counterbore, having a plurality of venturi shaped chambers therein, each of said venturi chambers having venturi inlet ports and a venturi exit port, each of said venturi chambers having a low pressure inlet orifice in the throat section of each of said venturi chambers, said low pressure inlet orifice being connected to a low pressure nose piece channel which communicates with said low pressure channels of said front body housing, said nose piece member having a plurality of high pressure inlet ports located in the front end of said nose piece member, each of said high pressure inlet ports being connected to a high pressure nose piece channel which communicates with said high pressure channels of said front body housing;

an annular protrusion located on the circumference of said nose piece member forward and adjacent to said venturi exit ports, said protrusion acting as an airstream spoiler having the effect of lowering the exiting air velocity from the venturi exit ports; and a plurality of protective nose piece covers, each of said nose piece covers having a weighted mass located in a rearward cover extension which encloses said venturi exit ports, each of said covers having a forward cover extension which encloses one of said venturi inlet ports and one of said high pressure inlet ports, a hinge groove located in said nose piece covers intermediate said rearward cover extension and said forward cover extension, wherein the setback forces of said projectile during in-bore acceleration act on said weighted masses causing said rearward extensions to hinge radially outward at said hinge groove thereby uncovering said venturi exit ports and causing said covers to be blown away from said nose piece member by the muzzle blast gases of a launch weapon.

* * * * *